US007963727B1

(12) United States Patent
Wauhop

(10) Patent No.: US 7,963,727 B1
(45) Date of Patent: Jun. 21, 2011

(54) RETAINING WALL BLOCK AND RETAINING WALL COMPRISED OF RETAINING WALL BLOCKS

(75) Inventor: Billy J. Wauhop, Belvidere, NJ (US)

(73) Assignee: E. Dillon & Company, Swords Creek, VA (US)

( * ) Notice: Subject to any disclaimer, the term of this patent is extended or adjusted under 35 U.S.C. 154(b) by 389 days.

(21) Appl. No.: 11/900,434

(22) Filed: Sep. 12, 2007

Related U.S. Application Data

(60) Provisional application No. 60/843,897, filed on Sep. 12, 2006, provisional application No. 60/901,118, filed on Feb. 13, 2007.

(51) Int. Cl.
*E02D 29/02* (2006.01)

(52) U.S. Cl. ..... 405/286; 405/284; 52/603; 52/604; 52/605

(58) Field of Classification Search ..... 405/262, 405/284, 286; 52/603, 604, 605
See application file for complete search history.

(56) References Cited

U.S. PATENT DOCUMENTS

| | | | | | |
|---|---|---|---|---|---|
| D184,747 | S | | 3/1959 | Livesay | D25/115 |
| 4,860,505 | A | | 8/1989 | Bender | |
| 5,064,313 | A | * | 11/1991 | Risi et al. | 405/286 |
| 5,161,918 | A | * | 11/1992 | Hodel | 405/286 |
| 5,257,880 | A | * | 11/1993 | Janopaul, Jr. | 405/286 |
| D343,461 | S | | 1/1994 | Powell | D25/114 |
| D347,070 | S | | 5/1994 | Anderson et al. | D25/114 |
| 5,337,527 | A | | 8/1994 | Wagenaar | |
| 5,457,926 | A | | 10/1995 | Jensen | |
| 5,484,236 | A | | 1/1996 | Gravier | |
| 5,505,034 | A | | 4/1996 | Dueck | |
| 5,622,456 | A | * | 4/1997 | Risi et al. | 405/286 |
| 5,678,958 | A | | 10/1997 | Rossi | |
| 5,711,129 | A | | 1/1998 | Woolford | 52/604 |
| 5,800,097 | A | * | 9/1998 | Martin | 405/286 |
| 5,941,042 | A | | 8/1999 | Dueck | |
| 5,951,210 | A | | 9/1999 | Maguire et al. | |
| 6,019,550 | A | * | 2/2000 | Wrigley et al. | 405/286 |
| 6,082,933 | A | * | 7/2000 | Maguire et al. | 405/286 |
| D445,512 | S | | 7/2001 | Sievert | D25/113 |
| D459,487 | S | | 6/2002 | Bott | D25/118 |
| D464,149 | S | | 10/2002 | Risi et al. | |
| D466,229 | S | | 11/2002 | Risi et al. | |
| D467,009 | S | | 12/2002 | Agee | D25/113 |
| 6,490,837 | B1 | | 12/2002 | Dueck et al. | |
| 6,523,317 | B1 | * | 2/2003 | Bott et al. | 405/286 |
| D475,143 | S | | 5/2003 | Hammer | |
| D485,371 | S | | 1/2004 | Burgess et al. | |
| 6,796,098 | B2 | * | 9/2004 | Hampton | 405/284 |
| 6,821,058 | B1 | | 11/2004 | Dawson | 405/284 |
| 6,829,867 | B2 | * | 12/2004 | Gresser et al. | 405/286 |
| D501,935 | S | | 2/2005 | Dawson et al. | D25/118 |

(Continued)

*Primary Examiner* — Frederick L Lagman
(74) *Attorney, Agent, or Firm* — Adams & Wilks

(57) ABSTRACT

A retaining wall block has spaced-apart front and rear sections interconnected by two laterally spaced-apart side sections that jointly define a through-cavity that extends through the block from a top face thereof to a bottom face thereof. Two or more protuberances protrude outwardly from the top face of the front section frontwardly of the through-cavity. A groove extends laterally in the bottom face of the front section frontwardly of the through-cavity. The groove is located and dimensioned relative to the protuberances so that two blocks can be stacked one atop another in staggered relation with one or more protuberances of the lower block engaged with one but not both of a front wall and a rear wall of the groove of the upper block and the upper block setback with respect to the lower block.

32 Claims, 9 Drawing Sheets

U.S. PATENT DOCUMENTS

| | | | | |
|---|---|---|---|---|
| 6,854,220 | B2 | 2/2005 | Dueck et al. | |
| 6,874,293 | B2 | 4/2005 | Manthei | |
| 7,059,808 | B2 * | 6/2006 | Risi | 405/284 |
| D530,832 | S | 10/2006 | Rainey | |
| D539,436 | S | 3/2007 | Magliocco et al. | D25/113 |
| 7,396,190 | B2 * | 7/2008 | Price | 405/284 |
| 7,448,830 | B2 * | 11/2008 | MacDonald et al. | 405/284 |
| 7,497,646 | B2 * | 3/2009 | Price | 405/284 |
| 2003/0127581 | A1 * | 7/2003 | Manthei et al. | 405/284 |
| 2003/0160147 | A1 * | 8/2003 | Manthei | 405/284 |
| 2005/0274085 | A1 * | 12/2005 | Risi | 52/604 |
| 2008/0085162 | A1 * | 4/2008 | Blundell | 405/284 |

* cited by examiner

RETAINING WALL BLOCK AND RETAINING WALL COMPRISED OF RETAINING WALL BLOCKS

RELATED APPLICATION

This application claims the benefit of U.S. Provisional Application Nos. 60/843,897 filed Sep. 12, 2006 and 60/901,118 filed Feb. 13, 2007.

BACKGROUND

1. Field

The present disclosure relates generally to the field of retaining walls and, more specifically, to retaining wall blocks and techniques for manufacturing retaining wall blocks.

2. Background Information

Retaining walls are widely used in a variety of landscaping applications. Typically, they are used to maximize or create level areas and also to reduce erosion and slumping. They may also be used in a purely decorative manner. In the past, retaining wall construction was labor intensive and often required the skills of trained tradespeople such as masons and carpenters. More recently, retaining wall construction has become significantly simplified with the introduction of self-aligning, modular, molded blocks of concrete that may be stacked in courses without the use of mortar or extensive training. With these types of retaining wall blocks, it is possible to erect a retaining wall quickly and economically, and the finished product creates the impression and appearance of a conventional block-and-mortar retaining wall.

The feature that allows the foregoing blocks to be so easily and precisely assembled is the interconnection between adjacent courses of blocks. Typically, each retaining wall block will include a projection and a recess located at oppositely facing surfaces, such as a top surface and a bottom surface, for example. The projection and recess are complementarily shaped, with the projection protruding beyond the top (or bottom) surface of the block with the recess extending inwardly from the bottom (or top) surface of the block. In use, a projection of a first block is received within the recess of a second block to interconnect and position the blocks adjacent each other in a predetermined relation. With a plurality of blocks, such interconnections make it possible to lay courses of blocks in an accurate and expedient manner. Moreover, such an assembled retaining wall is able to resist lateral forces exerted by the material being retained and reduce bowing. Blocks having these interconnections are usually the same size and may be assembled in a coplanar arrangement in only a simple, running bond pattern. In a variation of the aforementioned blocks, the projection and recess may be arranged so that adjacent courses are offset a predetermined amount. With this type of retaining wall block, each successive course may be offset from the preceding course by the same amount so that the assembled wall is skewed at a predetermined angle from the vertical. These blocks also have the dimensions to enable them to be set in only a simple running bond pattern.

A recent development in mortarless retaining walls has been the advent of blended pattern retaining walls. These walls differ from the aforementioned walls in that the preformed blocks used to construct a retaining wall are differently sized. This feature allows retaining walls to be assembled in a variety of patterns and bonds. Usually, these types of preformed blocks are horizontally and vertically oriented and have dimensions that are based upon an incremental unit such as the thickness of a horizontal, preformed block. For example, the thickness of a horizontal block is one increment and the height of a vertical block is two increments. With these types of preformed blocks, it is possible to construct a retaining wall with no discernable courses. A drawback of this type conventional mortarless retaining walls is that setbacks are not possible and the assembled retaining wall must be substantially vertical.

In an attempt to overcome the foregoing drawback with conventional mortarless retaining walls, a retaining wall may be arranged in thick courses, and the blocks within these thick courses may be randomly arranged. For example, a course may be two incremental units high within which the differently dimensioned preformed blocks are arranged. Alternatively, the course may be three incremental units high within which the differently dimensioned preformed blocks are arranged. There are several drawbacks with this type of wall. One drawback is that the vertical blocks dictate the height of the course. Thus, if vertical blocks are used, each entire course must be coplanar and all of the blocks must lie in the same plane. Otherwise, the projections of blocks in one course would not be able to be received within the recesses in blocks of another course, and the interconnection would be defeated. Another drawback with this type of retaining wall is that the number of arrangements available within each course is limited, and a truly random arrangement is not possible.

Another drawback with the foregoing conventional mortarless retaining walls is that the front faces of the finished blocks forming the retaining walls are typically not provided with an attractive finished appearance, and often require covering or painting before or after installation to form the retaining walls.

Moreover, low slump masonry concrete is well known in the art of retaining wall blocks. The low slump concrete products industry produces many concrete block units in useful and practical shapes by placing a low slump concrete mixture into a mold that has been positioned atop a steel, plastic or wooden production pallet. After the mold has been filled, a head or top plunger with shoes is lowered atop the mixture within the mold to consolidate the mixture, with vibration, sufficiently for demolding. The top of this newly formed concrete block unit can have an irregular top surface since the head or top plunger can have shoes manufactured to impose this irregular surface atop the block unit. The multiple sides of the block unit are generally vertical although they can take on many contours along and around their perimeter. The bottom of the newly formed block unit is flat along its horizontal surface, although the unit may have internal cavities. The bottom of the unit remains flat because this is the area that was in contact with the flat production pallet. After the unit has been demolded, it remains atop the production pallet to undergo curing. After curing, the unit is removed from the production pallet for possible splitting into multiple finished blocks before being consolidated in a cube for inventorying.

A method of adding a contour to the bottom of a green uncured low slump concrete retaining wall block that has been formed in a single mold is known. A mold is placed atop a production conveyor belt before the concrete mixture is introduced. Next, a single or multiple horizontal core bar or bars are positioned within the mold atop the production belt continuous over the bottom of the mold from front to back. Then the mold is filled with a low slump concrete mixture and the head or top plunger with shoes is lowered into the top of the mold for consolidation. After this function, the core bar or bars are extracted from the mold leaving a contoured void from front to back of the bottom of the unit atop the production belt. Lastly, the block is demolded and cured.

One major drawback of the foregoing conventional method is the additional production time required to install the core bar or bars into the mold before adding the concrete mixture and to extract them after mixture consolidation but before demolding the block. Also, the extent of contouring along the bottom of the block is limited to the ability of the resultant block unit to sustain structural integrity due to the plastic green uncured state of the vertical sidewalls positioned overtop and therefore spanning a contoured void.

SUMMARY

An object of the present disclosure is to provide a retaining wall that may be assembled without the use of mortar.

Another object is to provide retaining wall blocks that can be easily and rapidly stacked one atop another with each succeeding course setback relative to its preceding course and with the blocks of each course being staggered relative to the blocks of adjoining courses.

Another object is to provide retaining wall blocks having textured front faces that are divided into two panels of different widths by simulated dress joints that are the same in appearance as the actual joints between abutting blocks so that when the blocks are stacked in successive courses, all the panels of all the blocks are bordered by joints having the same appearance.

Yet another object is to provide processes that permit high speed, mass production of block units, and, in particular, retaining wall blocks.

A further object is to provide a method of manufacturing a retaining wall block in which a cured, molded retaining wall block structure that has protuberances on the top face thereof is ground on the bottom face thereof to provide a groove.

Yet another object is to provide a method of simultaneously manufacturing two or more retaining wall blocks in which a cured, molded block unit comprised of two or more retaining wall block structures joined together at common interfaces and having two or more protuberances on the top faces thereof are simultaneously ground on the bottom faces thereof to provide grooves after which the block unit is split along the common interfaces to obtain individual retaining wall blocks.

The foregoing and other objects of the present disclosure are carried out by a retaining wall block having spaced-apart front and rear sections interconnected by two laterally spaced-apart side sections that jointly define a through-cavity that extends through the block from a top face thereof to a bottom face thereof. Two or more protuberances protrude outwardly from the top face of the front section frontwardly of the through-cavity, and a groove extends laterally in the bottom face of the front section frontwardly of the through-cavity. The groove is located and dimensioned relative to the protuberances so that two blocks can be stacked one atop another in staggered relation with one or more protuberances of the lower block engaged with one but not both of a front wall and a rear wall of the groove of the upper block and the upper block setback with respect to the lower block.

In another exemplary embodiment, a retaining wall block has spaced-apart front and rear sections interconnected by two laterally spaced-apart side sections that jointly define a through-cavity that extends in a top-bottom direction through the block from a top face thereof to a bottom face thereof, two or more protuberances that protrude outwardly from the top face of the front section frontwardly of the through-cavity, and a groove that extends laterally in the bottom face of the front section frontwardly of the through-cavity. The groove is located and dimensioned relative to the protuberances so that two blocks can be stacked one atop another in staggered relation with one or more protuberances of the lower block engaged with one wall of the groove of the upper block and the upper block setback with respect to the lower block. The front section has a textured front surface that terminates at the top and at opposite sides of the front section in curved edges. The textured front surface is divided into two panels of different widths by a groove that extends in the top-bottom direction and that has opposed curved edges so that each panel terminates at the top and at opposite sides thereof in curved edges.

In another aspect, the present disclosure provides a retaining wall comprising successive courses of retaining wall blocks stacked one atop another with each succeeding course setback relative to its preceding course and with the blocks of each course being staggered relative to the blocks of adjoining courses. Each of the retaining wall blocks may be constructed according to any one of the foregoing exemplary embodiments of the retaining wall blocks.

Another aspect of the present disclosure provides a method of manufacturing a retaining wall block. A cured, molded retaining wall block structure having two or more protuberances protruding outwardly from a top face thereof is provided. A groove is formed in a bottom face, that is opposite the top face, of the cured, molded retaining wall block structure to provide a retaining wall block. The groove is located and dimensioned relative to the protuberances to enable two of the retaining wall blocks to be stacked one atop another in staggered relation with one or more protuberances of the lower retaining wall block engaged in the groove of the upper retaining wall block.

In another exemplary embodiment, a method of manufacturing retaining wall blocks is provided. A cured, molded block unit comprising at least two retaining wall block structures joined together at a common interface is provided, with each retaining wall block structure having two or more protuberances protruding outwardly from a top face thereof. A groove is formed in the bottom face of each joined together retaining wall block structure. The grooved retaining wall block structures are split apart at the common interface of the cured, molded block unit to obtain two individual retaining wall blocks.

Additional objects, advantages and features of the disclosure will be set forth in part in the description which follows, and in part will become apparent to those skilled in the art upon examination of the following or may be learned by practice of the disclosure. The objects and advantages of the disclosure may be realized and attained by means of the instrumentalities and combinations particularly pointed out in the appended claims.

DETAILED DESCRIPTION

Figure 1:
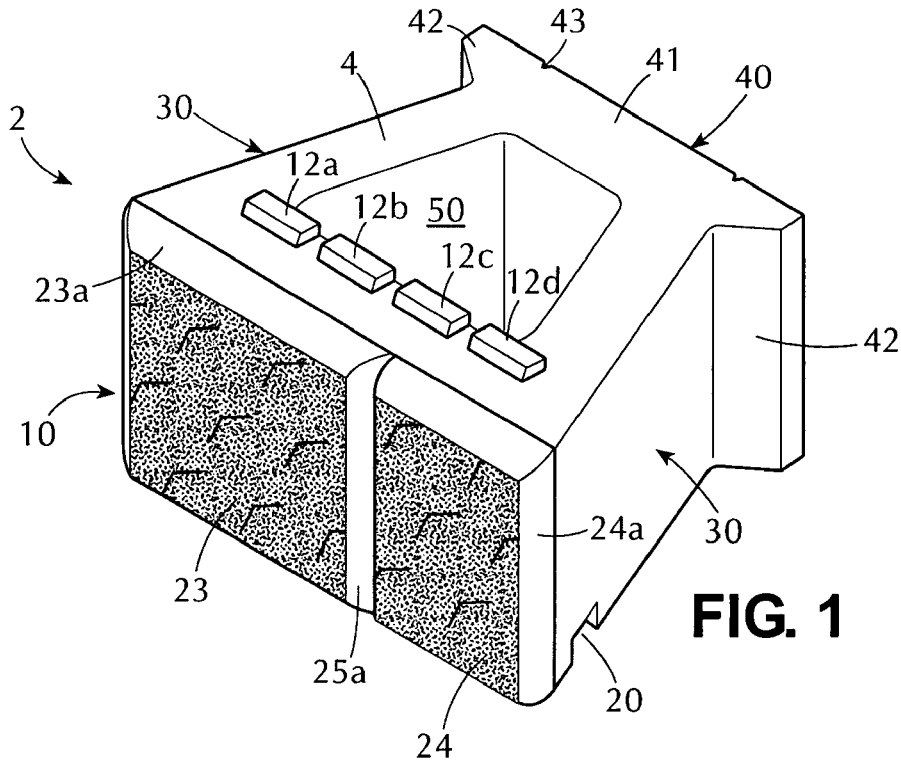
FIG. 1 is a top perspective view of a retaining wall block of one embodiment of the disclosure.
Figure 2:
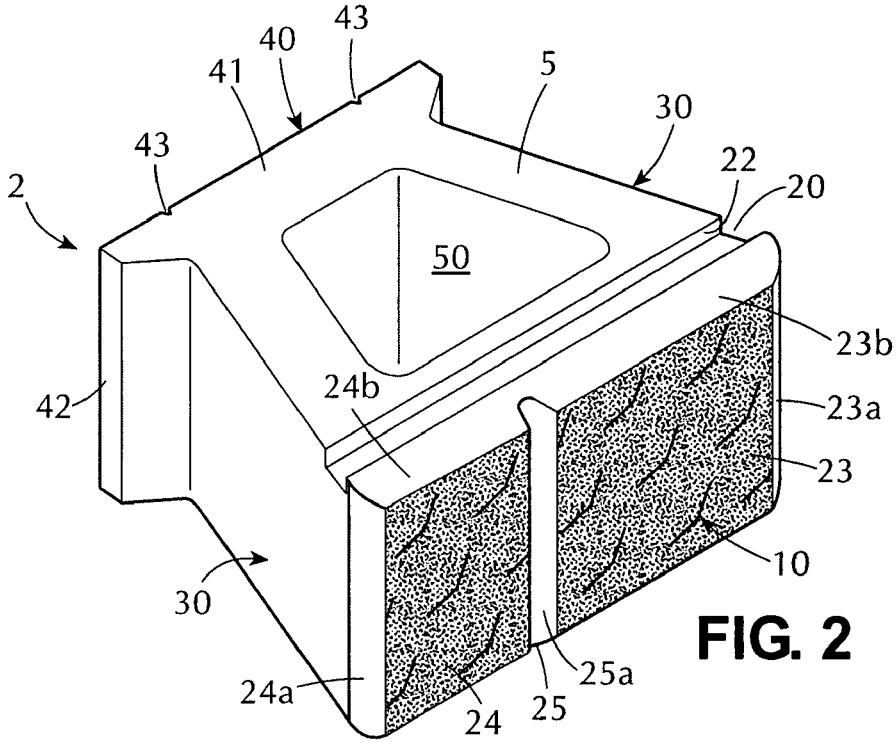
FIG. 2 is a bottom perspective view of the retaining wall block shown in FIG. 1.

The figures in the drawings are simplified for illustrative purposes and are not necessarily depicted to scale. To facilitate understanding, identical reference numerals have been used, where possible, to designate identical elements that are common to the figures, except that suffixes may be added, when appropriate, to differentiate such elements.

The appended drawings illustrate exemplary embodiments of the disclosure and, as such, should not be considered as limiting the scope of the disclosure that may admit to other effective embodiments. It is contemplated that features or steps of one embodiment may be beneficially incorporated in other embodiments without further recitation.

The term "exemplary" is used herein to mean "serving as an example, instance, or illustration". Any embodiment or design described herein as "exemplary" or "alternative" is not necessarily to be construed as preferred or advantageous over other embodiments or designs.

Figure 3:
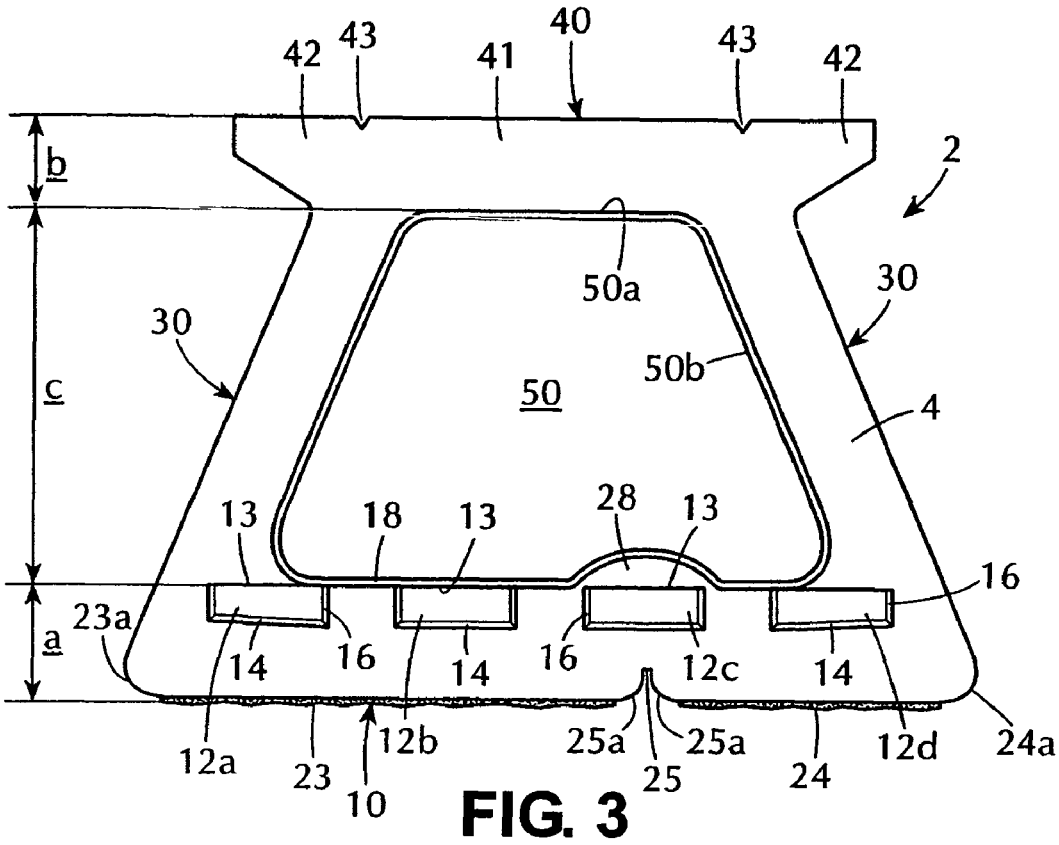
FIG. 3 is a top view of the retaining wall block.
Figure 4:
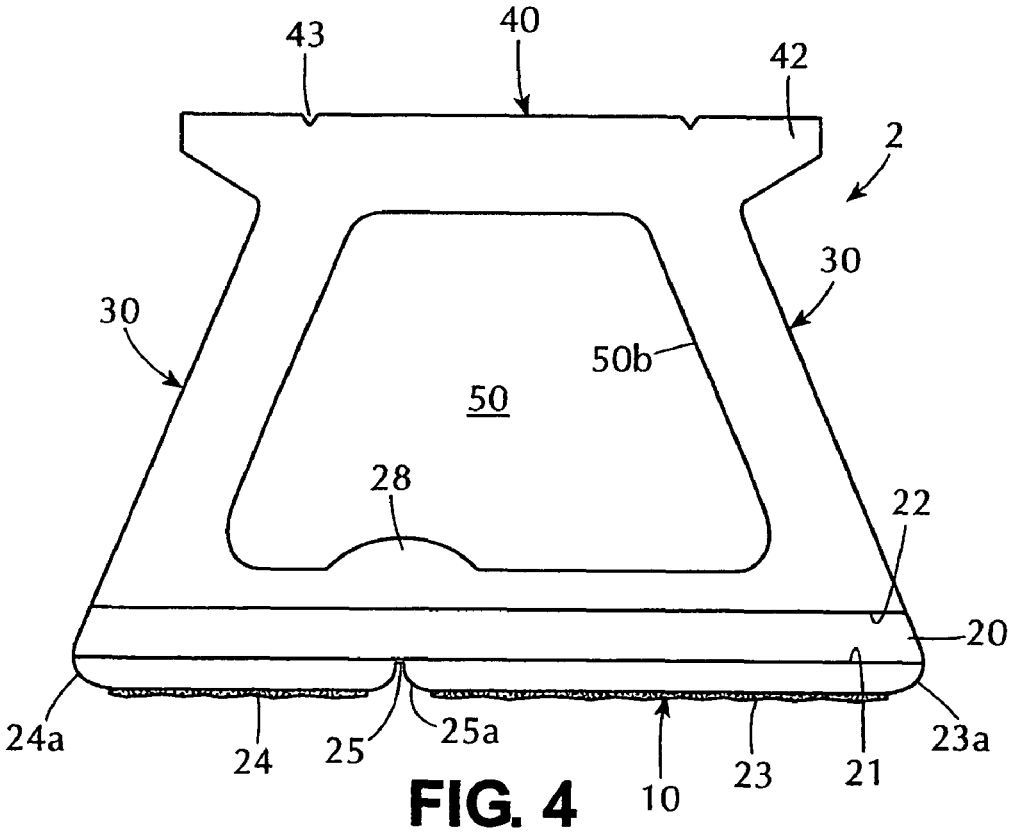
FIG. 4 is a bottom view of the retaining wall block.

Referring to the drawings, FIGS. 1-6 illustrate a retaining wall block 2 in accordance with one exemplary embodiment of the present disclosure. The retaining wall block 2 is a molded concrete structure, as described more fully hereinafter, comprised of a front section 10, two side sections 30, 30 and a rear section 40. The front section 10 and the rear section 40 are spaced apart from one another and interconnected by the side sections 30, 30. The two side sections 30, 30 are laterally spaced apart in the lateral or sideways direction of the block 2 and converge in a direction from the front section 10 to the rear section 40 so that the retaining wall block 2 has a trapezoidal shape. With reference to FIG. 3, the front section 10 extends a distance a in the front-rear direction, the rear section 40 extends a distance b and the side sections 30, 30 extend a distance c.

Figure 5:
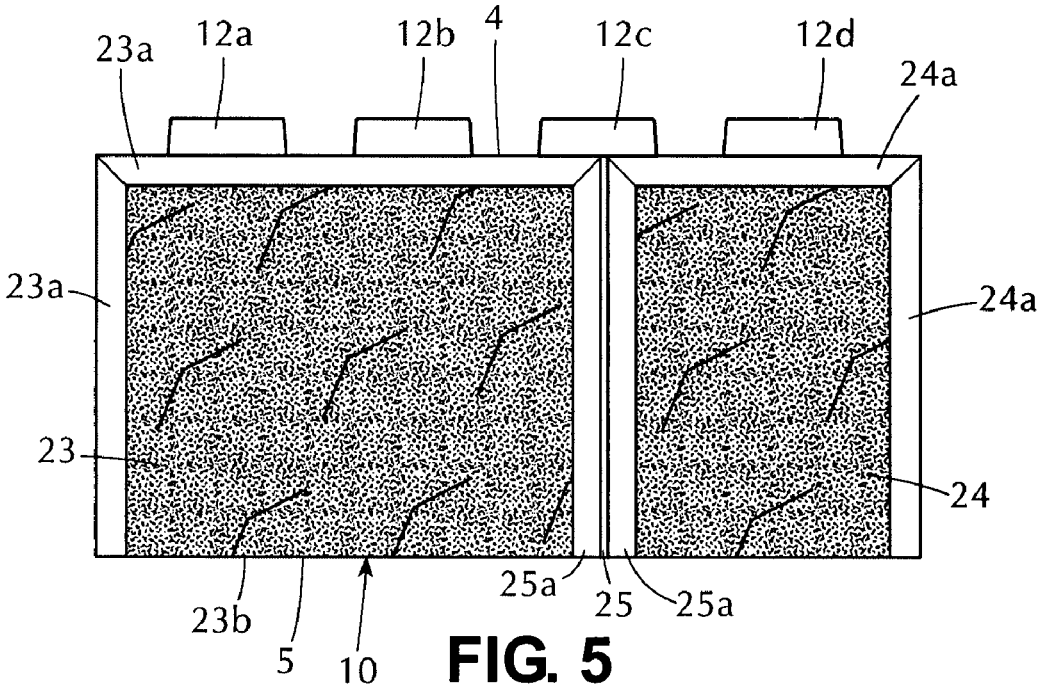
FIG. 5 is a front view of the retaining wall block.
Figure 8:
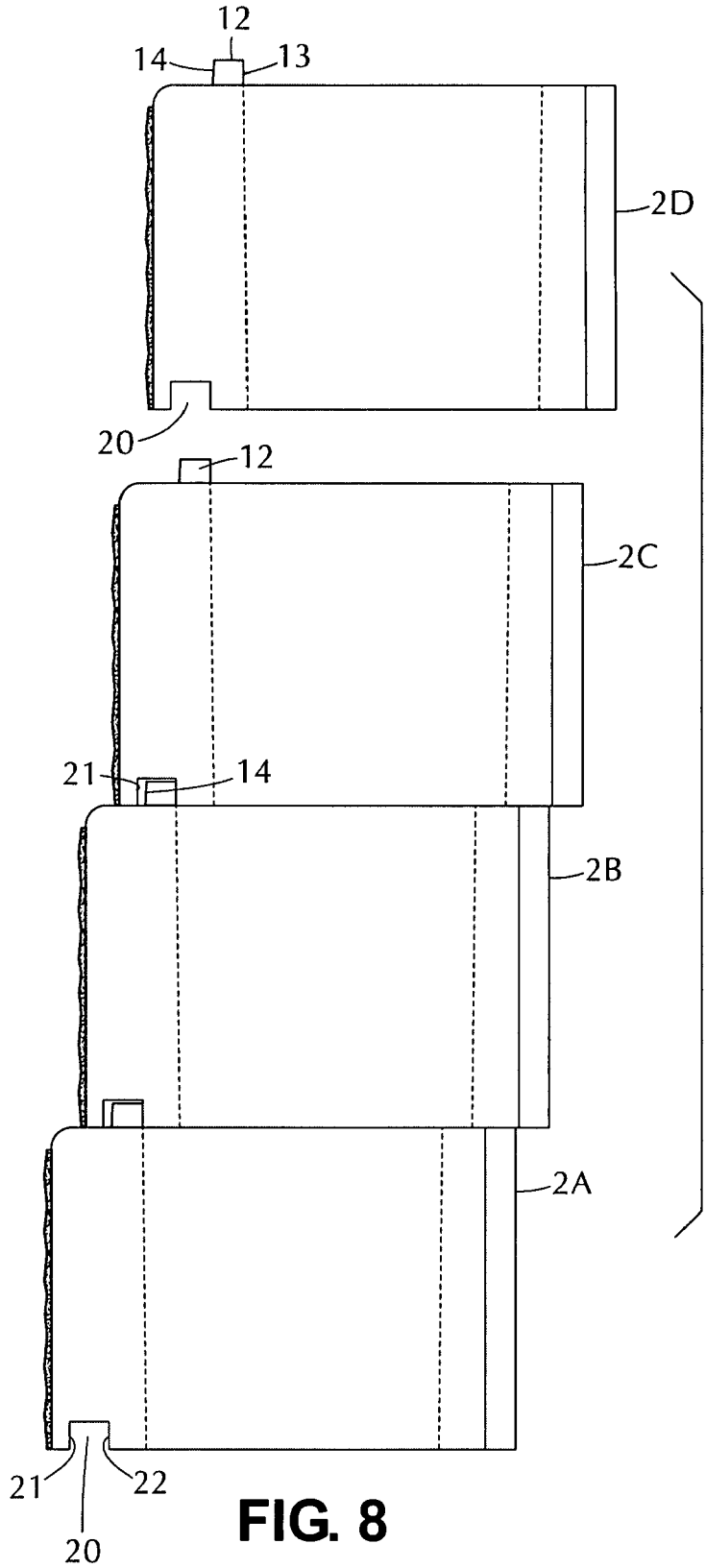
FIG. 8 is a side view of a retaining wall constructed of the retaining wall blocks and illustrating the setback of successive courses of blocks.

The interconnected front, side and rear sections define a center through-cavity 50 that extends completely through the retaining wall block 2 from the top face 4 of the block to the bottom face 5. The cavity 50 has a slight inward taper, generally on the order of 1°-1½°, in the top-bottom direction, as best seen in FIGS. 3, 5 and 8, so that the cavity opening 50*a* at the top of the block 2 is larger than the cavity opening 50*b* at the bottom of the block. This taper facilitates removal of the blocks from the mold during manufacture. The through-cavity 50 is provided to greatly reduce the block weight and thus facilitate transportation, handling and installation of the retaining wall blocks as well as to reduce the quantity of concrete and other constituents thereby lowering the cost of manufacture of the blocks.

The rear section 40 has a main part 41 and two lateral extension parts 42, 42 that extend outwardly in the lateral or sideways direction from the main part 41. The rear face of the rear section 40 is provided with score grooves 43, 43 that extend from the top face 4 to the bottom face 5. The score grooves 43 are provided to enable removal of one or both of the lateral extension parts 42, such as may be required, for example, when installing a retaining wall having a curvilinear section. The lateral extension parts 42 can be removed by striking them with a hammer so that they break away from the main part 41 and separate from the retaining wall block 2 at the region where the lateral extension parts 42 meet with the side sections 30.

In the following description of the preferred embodiments, exemplary retaining wall blocks are described with reference to particular exemplary dimensions to facilitate understanding of the disclosure. The disclosure is not, of course, limited or restricted to these dimensions, which are provided solely for illustrative purposes. To manufacture blocks of different sizes, these dimensions may be scaled up or down, or other dimensions all together could be used, as would be well understood by persons skilled in the art. In the case of the exemplary embodiment shown in FIGS. 1-6, the retaining wall block 2 has a widthwise or lateral dimension of 18", i.e., the maximum dimension of the front section 10, and a depth or front-rear dimension of 12", i.e., the maximum dimension between the front face of the front section 10 and the rear face of the rear section 40. The distance a is 2⅝", the distance b is 1¾" and the distance c is 7⅝".

In accordance with one aspect of the disclosure, the retaining wall block 2 is provided with protuberances on the top face thereof and a groove on the bottom face thereof so that when successive courses of retaining wall blocks are stacked one atop another with the blocks of each course being staggered relative to the blocks of adjoining courses, the protuberances of a preceding course of blocks will interlock with the grooves of a succeeding course of blocks. In accordance with another aspect of the disclosure, the protrusions and grooves are located and dimensioned such that in successive courses of retaining wall blocks, each succeeding course is set back relative to its preceding course.

In the exemplary embodiment shown in FIGS. 1-6, four protuberances 12*a*, 12*b*, 12*c*, 12*d* (collectively protuberances 12) protrude outwardly from the top face 4 of the front section 10. As used herein, the term "protuberance", unless otherwise qualified, is used in its broadest sense to refer to a protruding part, without limitation as to any particular configuration, including a lug, projection, knob, tab and protrusion. In this exemplary embodiment, the protuberance 12 have a generally rectangular shape though, as noted, may be of other shapes.

Figure 6:
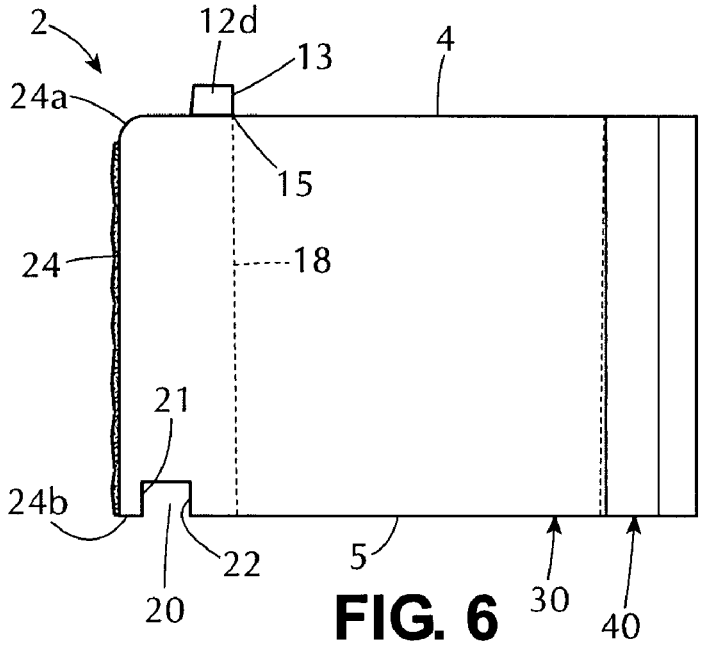
FIG. 6 is a right side view of the retaining wall block.

The protuberances 12*a*, 12*b*, 12*c*, 12*d* are laterally spaced apart from one another. As shown in FIGS. 3 and 6, the rear sides 13 of the protuberances 12 are flat and essentially perpendicular (i.e., within 1°-1½°) to the top face 4 of the front section 10. The flat rear sides 13 lie along an imaginary line that is coincident with a rear corner edge 15 of the front section 10. More particularly, the rear corner edge 15 defines the boundary between the top surface 4 and a rear surface 18 of the front section 10, is best seen in FIGS. 3 and 6, and except for a protruding portion 28 at the rear of the front section 10 (which is described later), the flat rear sides 13 of the protuberances 12 otherwise lie along a line coincident with the rear corner edge 15. The flat rear side 13 of the protuberance 12*b* is flush with the rear surface 18. The two outer protuberances 12*a* and 12*d* are positioned frontwardly of the front ends of the side sections 30 and 30, and the protuberance 12*c* is positioned in the region of the protruding portion 28.

As previously noted, the protuberances 12 in this exemplary embodiment have a generally rectangular shape with rear sides 13, front sides 14 and opposed lateral sides 16, 16. The two inner protuberances 12*b*, 12*c* have a uniform rectangular shape, and the two outer protuberances 12*a*, 12*d* have a generally rectangular but slightly tapered shape with the outer ends thereof being narrower in the width direction than the inner ends thereof. In the case of the exemplary block having the dimensions described above, the rectangularly-shaped protuberances 12*b*, 12*c* have a uniform width dimension of about ¾". The generally rectangularly-shaped protuberances 12*a*, 12*d* have a width dimension of about ½" at the outer ends and a width dimension of about ¾" at the inner ends so that the protuberances 12*a*, 12*d* are slightly tapered in the lengthwise direction thereof with the outer ends being of smaller width than the inner ends. As used herein, the term "about" means the specified dimensions as well as values within a range of ±1/16 inch of the specified dimensions. The reason for this slight taper of the two outer protuberances 12*a*, 12*d* is to aid in the construction of a slightly curved retaining wall without having the front sides 14 of the protuberances 12*a* and 12*d* engage the front walls 21 of the grooves 20. The front sides 14 and the two opposed lateral sides 16, 16 of the protuberances 12 are likewise flat though slightly inclined, for example, at an angle of 5°, from the normal so that the protuberances 12 are slightly tapered in the thickness direction, which aids in the release of the mold head or top plunger with shoes from the surfaces of the newly formed concrete protuberances. The inclination of the sides is greatly exaggerated in the drawings for illustrative purposes.

The bottom face 5 of the front section 10 is provided with a groove 20 that extends laterally or sideways through-out the width of the front section 10. As used herein, the term "groove", unless otherwise qualified, is used in its broadest sense to refer to an elongate hollowed-out region, without limitation as to any particular configuration, including a channel, passage, slot and recess. The groove 20 has a front wall 21 and a rear wall 22, which are spaced apart from one another in the front-rear direction of the retaining wall block 2. In this exemplary embodiment, the front and rear walls 21 and 22 are perpendicular to the bottom face 5, though perpendicularity is not required. The width of the groove 20, i.e., the distance between the front wall 21 and the rear wall 22, is significantly greater than the width of the protuberances 12. For example, if the protuberances 12 have a maximum widthwise dimension of about ¾", the groove 20 would have a widthwise dimension of about 1". This ensures that the protuberances 12 of an underlying block fit loosely in the groove 20 of an overlying block thereby facilitating stacking of the retaining wall blocks one atop another and permitting forward/rearward adjustment of an upper block relative to a lower block. In addition, the clearance between the protuberances 12 of one block and the groove walls 21 and 22 of another block permits variation of the setback amount as well as allowing for slight curvatures in the retaining wall.

Figure 7:
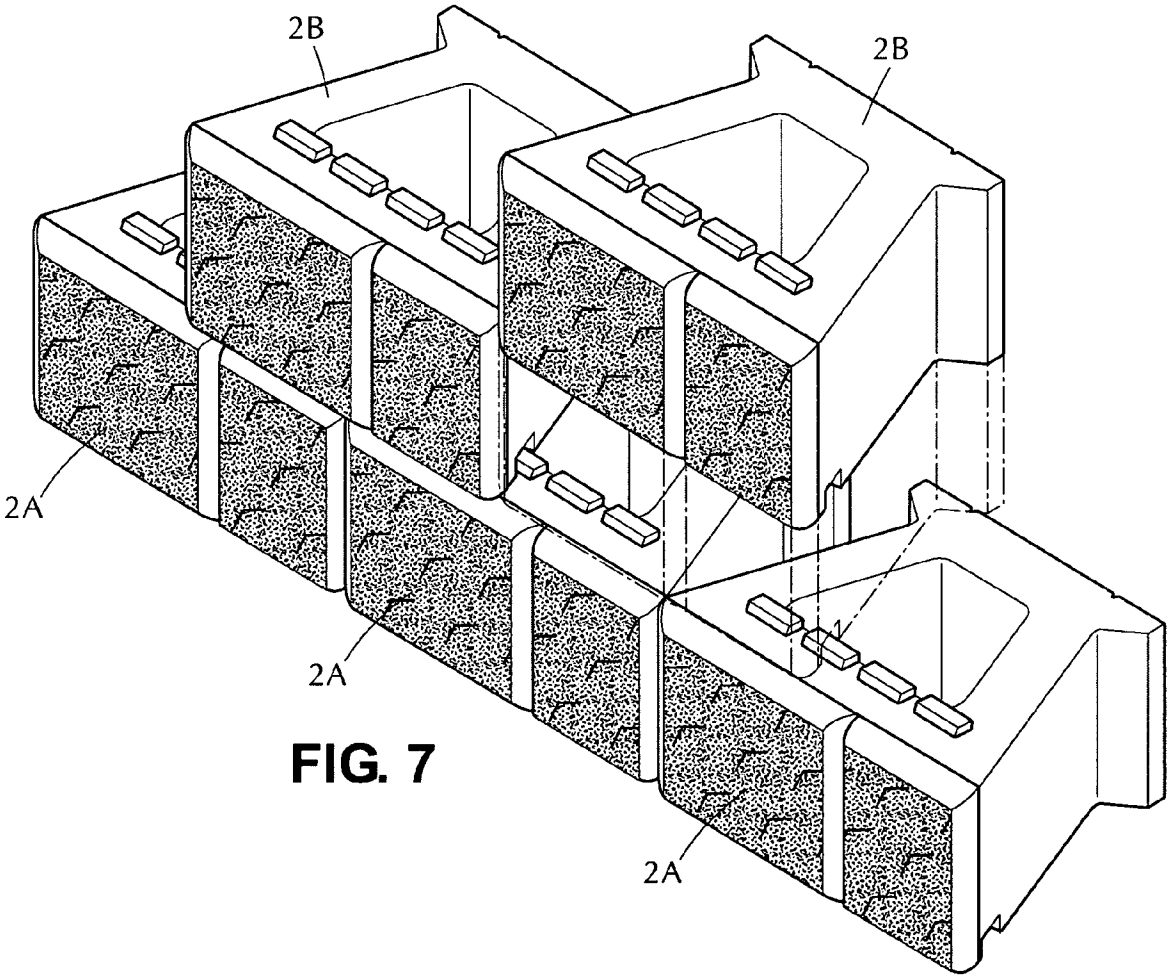
FIG. 7 is a perspective view illustrating the manner of erecting a retaining wall using the retaining wall blocks.

In the course of erecting a retaining wall using the retaining wall blocks 2, and with reference to FIGS. 7-8, the blocks 2A in the first course are laid in side-by-side abutting relation, and the blocks 2B in the subsequent upper course are laid in the same way but offset or laterally staggered so that in each successive course, each upper block 2B overlaps two adjacent blocks 2A, 2A in the course directly below. When installing an upper block 2B on two adjacent lower blocks 2A, 2A, the groove 20 of the upper block 2B is loosely fitted over protuberances 12 of the two lower blocks 2A, 2A, and then the upper block 2B is pushed forwardly so that the flat rear sides 13 of the protuberances 12 engage with the rear wall 22 of the groove 20, as shown in FIG. 8. In this manner, the upper block 2B is interlocked with the two adjacent lower blocks 2A, 2A and the upper block 2B is set back relative to the lower blocks 2A, 2A, and the setback distance is chosen to fully expose the upper curved edges of the lower blocks 2A, 2A so that, as shown in FIG. 7, the vertical and horizontal joints of all the blocks have the same appearance. Successive courses of blocks 2C, 2D, etc. are laid in a similar manner to erect a retaining wall in which each succeeding course is set back from its preceding course. The required setback is predetermined and automatically established due to the dimensions and locations of the protuberances 12 and the grooves 20. By such a construction, vertically abutting blocks 2 are interlocked to one another by engagement of the rear sides 13 of the protuberances 12 with the rear walls 21 of the grooves 20, and a clearance space exists between the front sides 14 of the protuberances 12 and the front walls 22 of the grooves 20. The clearance between the protuberances and the groove walls allow for slight shifting or displacement of the blocks relative to one another during installation due, for example, to manufacturing tolerances.

In an alternative embodiment, the width of the grooves 20 could be made wider in width to provide a correspondingly deeper setback. However, such an alternative construction would diminish the uniformity of the joints between all of the blocks and detract from the aesthetically attractive appearance created when all of the joints are the same.

In accordance with another aspect of the disclosure, the front face of the front section 10 of the retaining wall block 2 is textured and provided with a split-panel that divides the front face into two textured panels of different widths. As shown in FIGS. 1-3 and 5, the front surface of the front section 10 is divided into two panels 23 and 24 of different widths by a groove 25 that extends in the top-bottom direction which, in this exemplary embodiment, is the vertical direction. The depth of the groove 25 is slightly greater at the top face 4 than at the bottom face 5. The groove 25 constitutes a manufactured dress joint that exhibits the same appearance between the panels 23 and 24 as exhibited by the actual joints between the panels 23 and 24 and the panels of laterally adjacent retaining wall blocks as illustrated in FIG. 7. Stated otherwise, the curve-edged groove 25 constitutes a simulated joint that simulates the actual joints between adjacent panels of laterally abutting retaining wall blocks in an erected retaining wall.

To preserve the structural integrity of the retaining wall block 2 due to the presence of the groove 25, the rear side of the front section 10 has a protruding portion 28 in the region directly behind the groove 25. The protruding portion 28 protrudes into the through-cavity 50 and, like the groove 25, extends in the top-bottom direction from the top surface 4 to the bottom surface 5 of the front section 10.

As illustrated in FIGS. 1-6, the panel 23 terminates at its top and outer side in curved edges 23*a*. Similarly, the panel 24 terminates at its top and outer side in curved edges 24*a*. The groove 25 likewise has opposed curved edges 25*a*. All of the curved edges 23*a*, 24*a*, 25*a* are rounded and have the same size, shape and curvature and preferably have a smooth, gentle curvature that creates an aesthetically pleasing appearance.

Another advantage of the rounded edges 23*a*, 24*a*, 25*a* is that they resist chipping, which is a common problem with sharp edges during manufacturing, inventorying, shipping and installation. The bottom edge 23*b* of the panel 23 and the bottom edge 24*b* of the panel 24 are flat and have no curvature.

With reference to FIGS. 7-8, when using the retaining wall blocks 2 to construct a retaining wall, the blocks 2A in the first course are laid in side-by-side abutting relation, and the blocks 2B in the subsequent upper course are laid in the same way but offset or laterally staggered so that in each successive course, each upper block 2B overlaps two adjacent lower blocks 2A, 2A in the course directly below. Due to the offset between the protuberances 12 and the grooves 20, the blocks in each successive course are set back relative to the blocks in the preceding course. As previously noted, the setback distance is preselected to fully expose the upper curved edges 23*a*, 24*a* of the lower blocks 2A, 2A so that, as shown in FIG. 7, the vertical and horizontal joints of all the blocks have the same appearance. The required setback is predetermined and automatically established due to the dimensions and locations of the protuberances 12 and the grooves 20. Due to the flat bottom edges 23*b* and 24*b* of the panels 23 and 24, all the panels of all the retaining wall blocks are bordered by the curved, rounded edges 23*a*, 24*a*, 25*a*, which presents an aesthetically pleasing and attractive appearance. The simulated dress joints created by the curved edges 25*a* of the grooves 25 are virtually indistinguishable from the actual joints between adjacent blocks to an observer. The use of the split-panel technique in this manner results in a retaining wall in which the joints appear to be more random than would otherwise be the case. During installation of the retaining wall, the likelihood of having two repeating vertical joints in two adjacent courses is greatly diminished thereby obviating the need of the installer having to slow down the installation to cut blocks to eliminate vertical alignment of joints.

In an alternative embodiment, the outer side edges 23*a*, 24*a* and/or the groove edges 25*a* of the panels 23, 24 may have shapes other than as illustrated and may be inclined or angled relative to the top and bottom faces 4 and 5 of the retaining wall block. This provides a wide degree of designed freedom in creating textured panels having different decorative or ornamental patterns.

In accordance with a further aspect of the disclosure, the width of the panels 23 and 24 may be freely selected. To minimize the likelihood of having repeated or aligned vertical joints in two adjoining courses of retaining wall blocks, the width of one panel should preferably, but not necessarily, be 1.2 to 3 times greater than the width of the other panel. If the panel width ratio is made less than 1.2, the two panels become too similar in size thereby increasing the probability of having vertically aligned joints in adjacent courses. Similarly, if the panel width ratio were made greater than 3, there would be an increased probability of having vertically aligned joints in adjacent courses.

Figure 9:
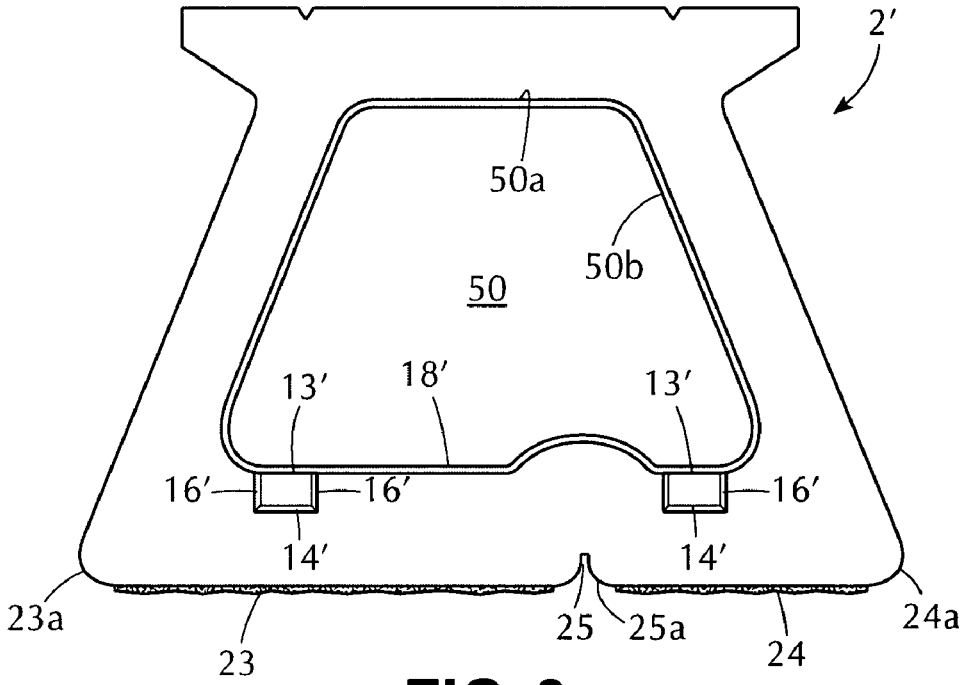
FIG. 9 is a top view of a retaining wall block of another embodiment of the disclosure.

Another exemplary embodiment of a retaining wall block in accordance with the present disclosure is shown in FIG. 9. In this embodiment, a retaining wall block 2' is provided with only two protuberances 12*a*' and 12*b*' instead of four protuberances as in the case of the retaining wall block 2 illustrated in FIGS. 1-6. Each of the protuberances 12*a*', 12*b*' has a flat rear side 13' that is flush with a rear surface 18' of a front section 10' of the block 2'. In this embodiment, the protuberances 12*a*', 12*b*' have a rectangular shape with opposed front and rear sides 13' and 14' and two opposed lateral sides 16', 16'. The front side 14' and the two lateral sides 16', 16' are likewise flat though slightly inclined, for example, at an angle of 5°, from the normal. The inclined sides are greatly exaggerated in FIG. 9 for clarity.

In other respects, the retaining wall block 2' is the same, and has the same exemplary dimensions, as the retaining wall block 2 illustrated in FIGS. 1-6. The two-protuberance block 2' is used in the same manner as the four-protuberance block 2, the only difference being that one instead of two protuberances of a lower block engage in the grooves of two overlapping upper blocks.

The four-protuberance blocks 2 illustrated in FIGS. 1-6 may also be easily converted to two-protuberance blocks by simply removing the two inner protuberances 12*b* and 12*c*, which can easily be done by a chisel and hammer at the jobsite. In this manner, the retaining wall block 2 may be used as either a four-protuberance or two-protuberance block, depending on the circumstances, thereby obviating the need for manufacturing two difference blocks to achieve the same purpose.

An additional aspect of the disclosure concerns the process or method for forming the retaining wall blocks 2 and 2'. Generally, the process is initiated by mixing dry cast masonry concrete that will form the blocks. For ease of description, the method of manufacturing the retaining wall blocks will be described with reference to a two-protuberance block and the method is equally applicable to manufacturing a four-protuberance block. Dry cast, low slump masonry concrete is well known in the art of retaining wall blocks. The concrete will be chosen so as to satisfy predetermined strength, water absorption, density, shrinkage, and related criteria for the block so that the block will perform adequately for its intended use. If desired, color can be added to the concrete mix by way of pigmentation or by the addition of colored aggregate as is well known in the art of casting concrete blocks. A person having ordinary skill in the art would be able to readily select a material constituency that satisfies the desired block criteria. Further, the procedures and equipment for mixing the constituents of the dry cast masonry concrete are well known in the art.

Once the concrete is mixed, it is transported to a hopper, which holds the concrete near a mold (not shown). In this exemplary embodiment, the mold is constructed to permit the formation of a block unit 100, as shown in FIGS. 10-14, which in this exemplary embodiment is a two-block unit and from which two individual retaining wall blocks 2*a*, 2*b* can be obtained by the additional process steps described below. That is, the mold is selected so that the two blocks 2*a*, 2*b* are formed in face-to-face contact by a single casting process. For this purpose, the mold is provided with mold parts (e.g., mold cavities) that conform in shape to the corresponding parts of the blocks 2*a*, 2*b* including the protuberances 12*a*-12*d*, grooves 25, curved edges 23*a*, 24*a*, 25*a*, and through-cavities 50 as described above, except for the grooves 20 which, according to the present disclosure as further described below, are formed after demolding and curing of the block unit 100, but prior to a step of splitting the block unit 100 along a common interface or split line 160 to obtain the individual blocks 2*a*, 2*b*. For example, the walls of the mold should measure the height and depth of the resulting blocks, and should be made of a thickness which will accommodate the processing parameters of block formation given a specific mold composition. In a more specific example, to provide the converging side sections 30 of the blocks 2*a*, 2*b*, corresponding converging mold side walls must be provided in the mold.

When forming block unit 100, a flat production pallet made of steel, plastic, or wood, for example, is positioned beneath the mold. An example of the pallet is denoted by numeral 130 in FIGS. 10-12, which show the pallet 130 supporting the block unit 100 in a state after the block unit 100 has been removed from the mold. After positioning the pallet 130 beneath the mold, an appropriate amount of concrete mixture from the hopper is loaded, via one or more feed drawers, into the mold assembly (e.g., via the mold cavities). The process and equipment for transporting the concrete mixture and loading it into the mold are well known in the art.

The concrete mixture in the mold must next be compacted or consolidated to densify it. This is accomplished primarily through vibration of the concrete mixture, in combination with the application of pressure exerted on the concrete mixture from above. The vibration can be exerted by vibration of the pallet underlying the mold (table vibration), or by vibration of the mold (mold vibration), or by a combination of both actions. As is well known in the art, the pressure is exerted by a compression head that carries one or more stripper shoes that contact the concrete mixture from above. The timing and sequencing of the vibration and compression is variable, and depends upon the characteristics of the concrete mixture and the desired results. The selection and application of the appropriate sequencing, timing, and types of vibrational forces, are within the ordinary skill in the art. Generally, these forces contribute to fully filling the mold (e.g., the forming cavities), so that there are not undesired voids in the finished block, and to densifying the concrete mixture so that the resulting finished blocks 2*a*, 2*b* will have the desired weight, density, and performance characteristics.

After densification, the pre-cured block unit 100 is discharged from the mold. Preferably, discharge occurs by lowering the pallet 130 relative to the mold, while further lowering the stripper shoe through the mold cavity to assist in stripping the pre-cured block unit 100 from the mold. The stripper shoe is then raised upwardly out of the mold and the mold is ready to repeat this production cycle.

Figure 10:
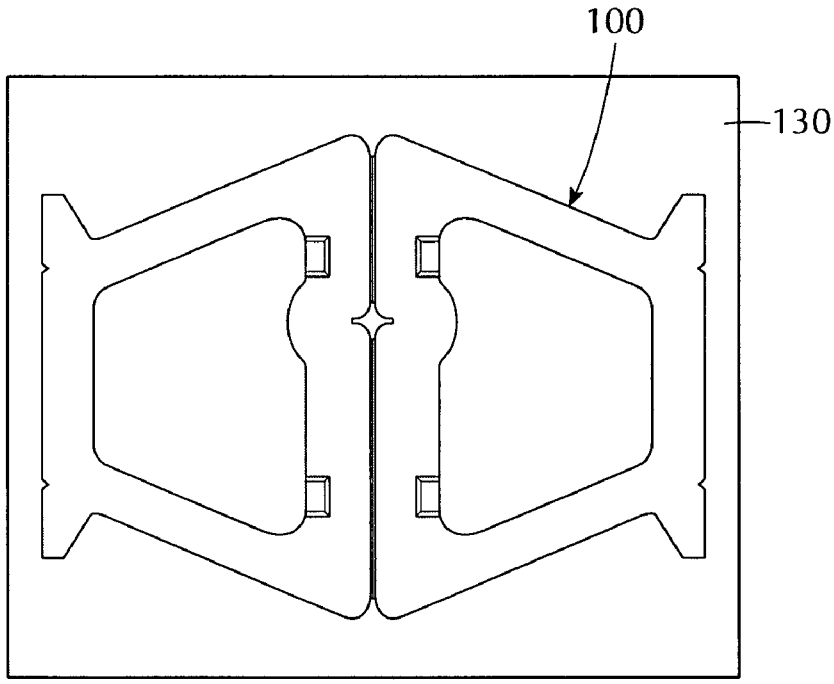
FIG. 10 is a plan view illustrating one stage of manufacture of retaining wall blocks from retaining wall block structures in one embodiment of the disclosure.
Figure 11:
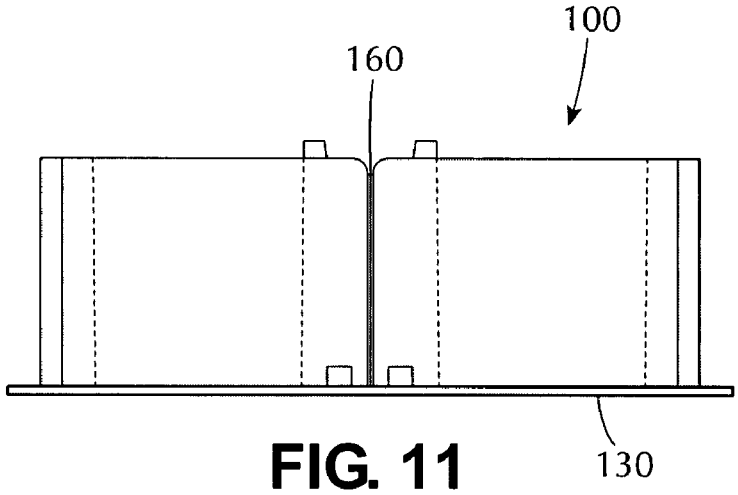
FIG. 11 is a side view of the retaining wall block structures in FIG. 10.
Figure 12:
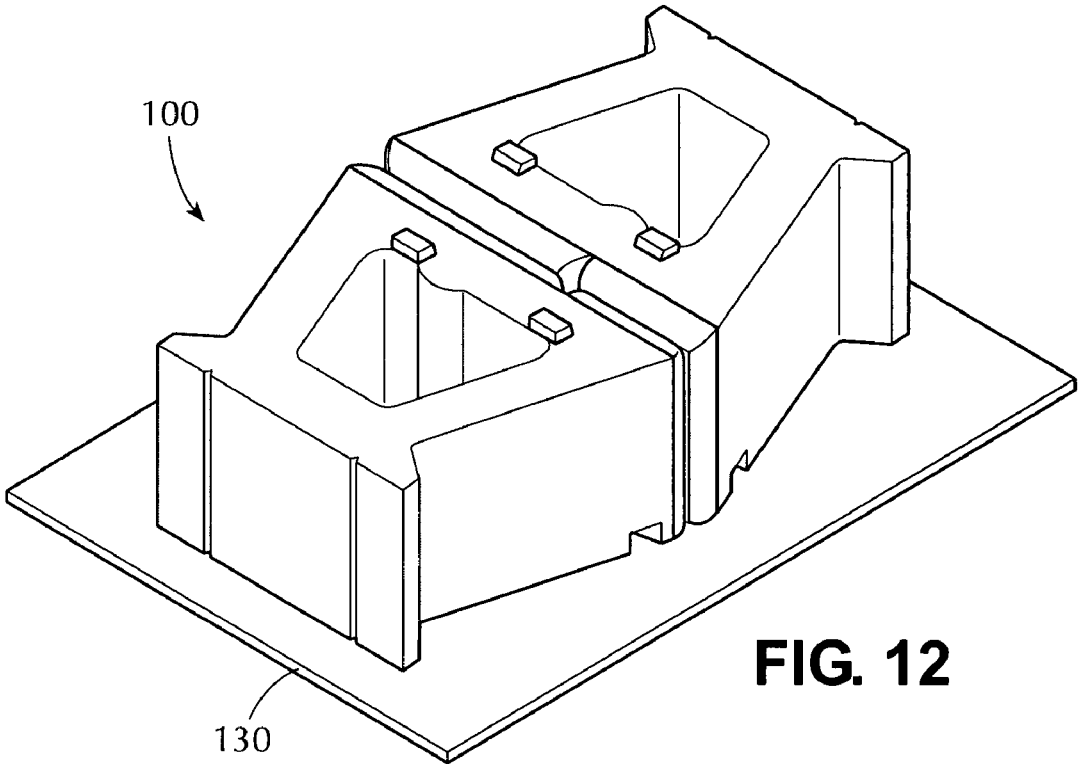
FIG. 12 is a perspective view of the retaining wall block structures shown in FIG. 10.

FIGS. 10-12 show the state of the pre-cured block unit 100. Once the pre-cured block unit 100 has been removed from the mold, it can be transported away from the mold assembly for subsequent curing. The block unit 100 may be cured through any means known to those of skill in the art. Examples of curing processes that are suitable include air curing, moist curing, autoclaving, and steam curing. Any of these processes for curing the block unit 100 may be implemented by those of skill in the art. Once cured, the block unit 100 is removed from the pallet 130.

After curing, the cured, molded block unit 100 consists of two retaining wall block structures that are joined together at the common interface or split line 160, with each of the retaining wall block structures having two or more of the protuberances 12 protruding outwardly from the top face 4 thereof.

The cured, molded block unit 100 is then removed from the pallet 130 and passed through a grinding station having a milling or grinding unit (hereinafter "grinding unit") to form grooves 20 corresponding to the groove 20 described above with reference to the retaining wall block 2 shown in FIGS. 1-6. More specifically, FIGS. 13 and 14 show embodiments of grinding units 140, 150 for simultaneously forming two grooves 20 in the bottom of the block unit 100 at portions corresponding to the bottom faces 5 of the blocks 2*a*, 2*b*.

Figure 13:
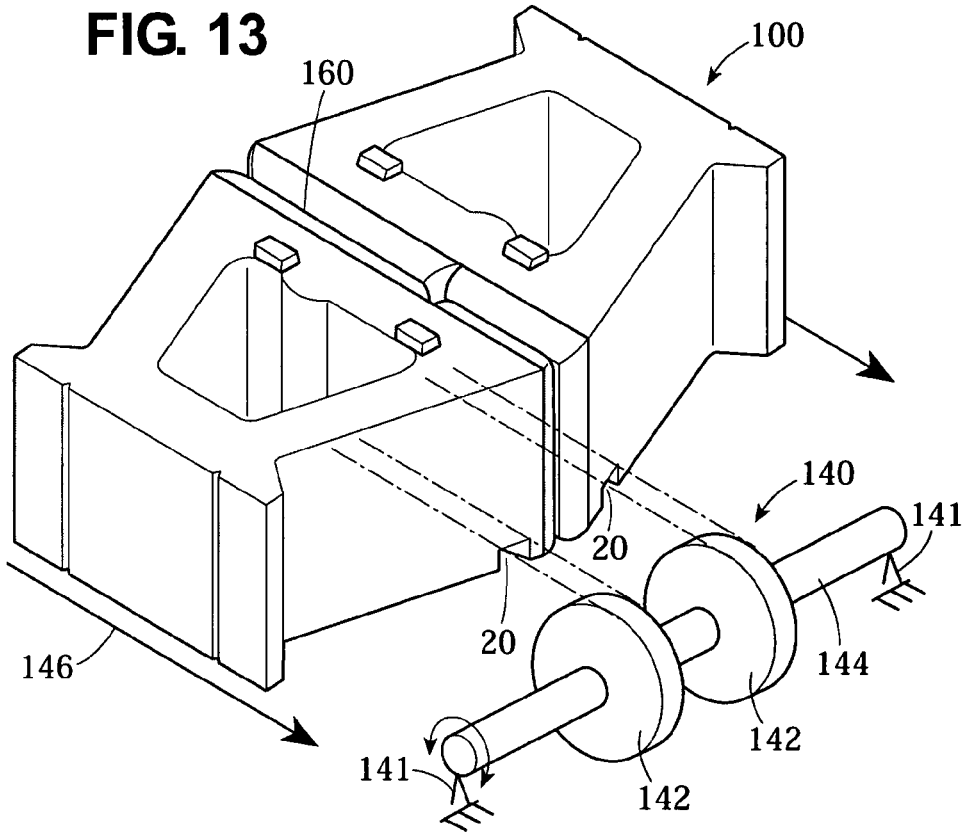
FIG. 13 is a perspective view illustrating the formation of grooves in bottom faces of the retaining wall block structures in another stage of manufacture in one embodiment of the disclosure.

In the exemplary embodiment shown in FIG. 13, the grinding unit 140 comprises a rotationally driven arbor 144 mounted on a stationary base 141, and two grinding wheels 142 mounted on the arbor 144 for rotation therewith. The arbor 144 is positioned in-line with the travel of the block unit 100 in the direction denoted by arrow 146 as it is being transported through the grinding unit 140 on its way to either a splitting station, as further described below, and/or to a cubing station for consolidation and inventorying.

Figure 14:
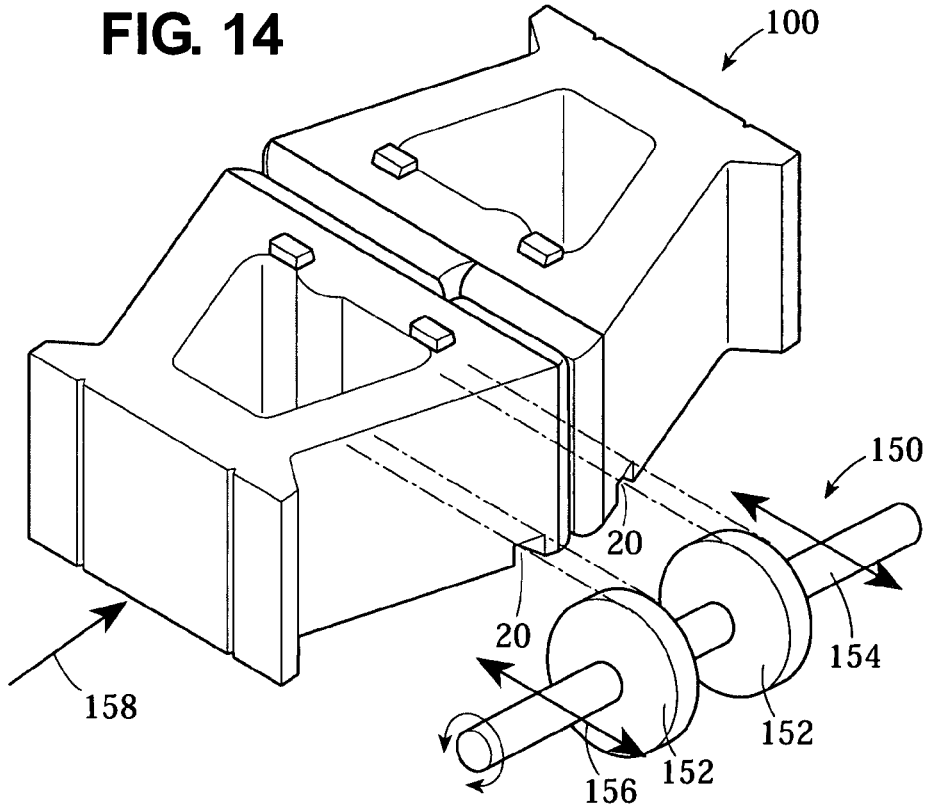
FIG. 14 is a perspective view illustrating the formation of grooves in bottom faces of the retaining wall block structures in another embodiment of the disclosure.

In the exemplary embodiment shown in FIG. 14, the grinding unit 150 comprises an arbor 154 that is mounted to undergo rotation as well as displacement in a direction denoted by arrow 156, and two grinding wheels 152 mounted on the arbor 154 for rotation therewith. During a grinding operation, the grinding unit 150 traverses the bottom of the block unit 100 while the block unit is held stationary. The movable arbor 154 traverses the block unit 100 in the direction denoted by the arrow 156 which is generally perpendicular to the direction of travel of the block unit 100 denoted by arrow 158 as it is being transported to and through the grinding unit 150 on its way to either the splitting station and/or to a cubing station for consolidation and inventorying.

Thus, in the embodiment shown in FIG. 13, the formation of the grooves 20 in the bottom of the block unit 100 is accomplished by moving the block unit 100 past the rotating grinding wheels 142 supported by the stationary arbor 144 (i.e., the arbor 144 is mounted to undergo only rotation during grinding operation). In the embodiment shown in FIG. 14, on the other hand, the formation of the grooves 20 in the block unit 100 is accomplished by the rotating grinding wheels 152 which are traversed along the bottom of the block unit 100 (i.e., the arbor 154 is mounted to undergo rotation and displacement relative to the block unit 100 during a grinding operation) while the block unit 100 is held stationary.

Figure 15:
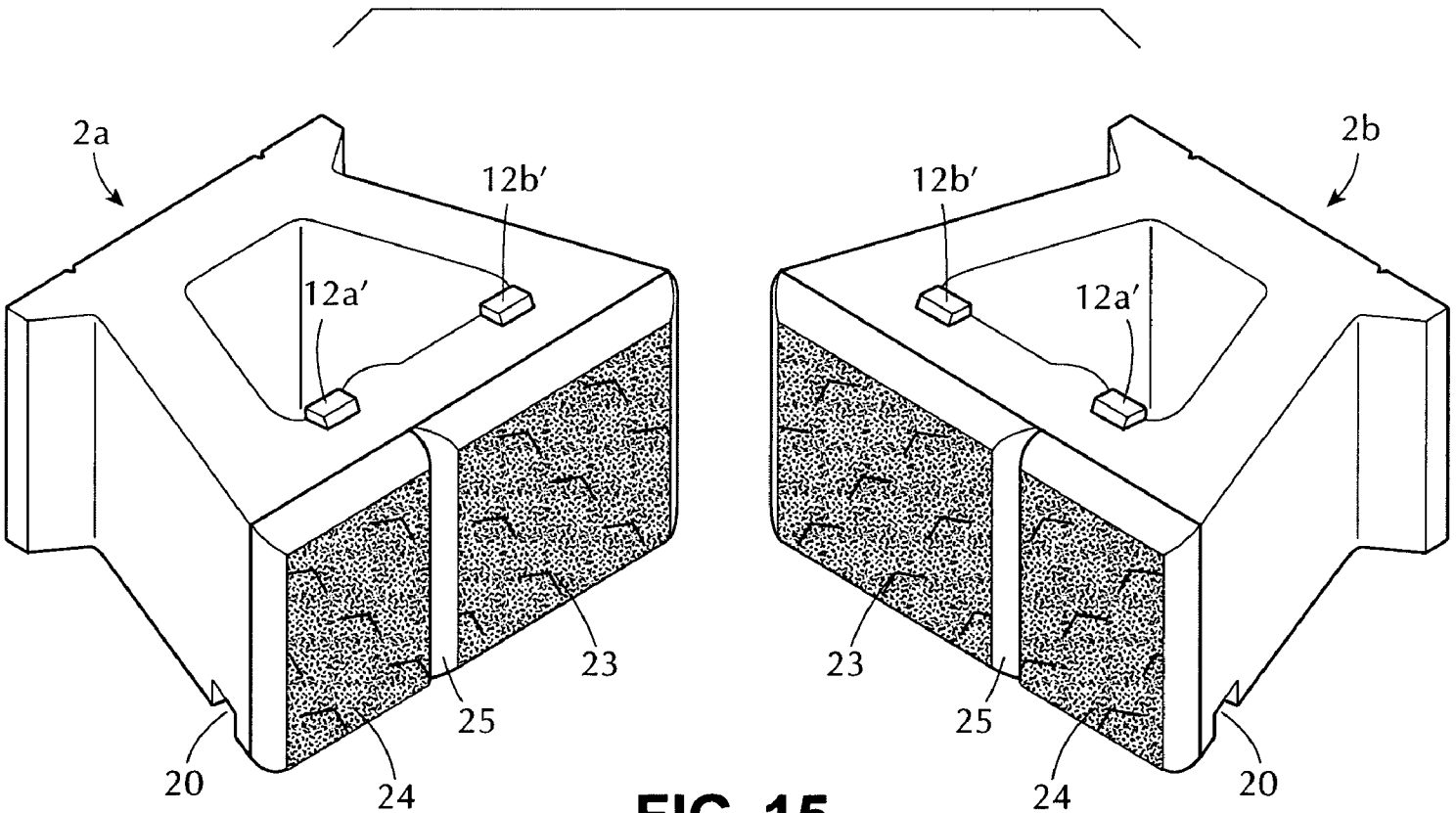
FIG. 15 is a perspective view illustrating another stage of manufacture in which the grooved retaining wall block structures are split into individual retaining wall blocks.

After formation of the grooves 20 in the block unit 100 as described above with reference to FIGS. 13-14, the block unit 100 is transported to a splitting station where it is split along a split line 160 to separate the block unit 100 into the two individual blocks 2*a*, 2*b* as shown in FIG. 15. The split line 160 is formed during molding of the block unit 100 and corresponds to the perimeter of the opposed textured front surfaces of the confronting blocks 2*a*, 2*b*. The splitting process can be performed manually using a chisel and hammer or can be performed using machines known to those skilled in the art for such purposes. After the splitting process, the panels 23, 24 of each of the blocks 2*a*, 2*b* are provided with a textured front surface which is exposed and visible when the blocks 2*a*, 2*b* are assembled to form a retaining wall as shown in FIG. 7, for example. Also after the splitting process, the panels 23, 24 of the blocks 2*a*, 2*b* are bordered by the curved, rounded edges 23*a*, 24*a*, and 25*a*, and are provided with the dress joints created by the curved edges 25*a* of the groove 25, as described above for FIGS. 1-6. The textured front surface of the panels 23, 24, the curved, rounded edges 23*a*, 24*a*, and 25*a*, and the dress joints present an aesthetically pleasing appearance and adds to the attractiveness of a retaining wall constructed of the blocks 2*a*, 2*b*.

Once split, the blocks 2*a*, 2*b* can be packaged for storage and subsequent shipment to a jobsite, and can then be used with other cured blocks in forming a structure, such as the retaining wall shown in FIG. 7.

From the foregoing description, it can be seen that the present disclosure comprises improved retaining wall blocks, methods of manufacturing the retaining wall blocks, and retaining walls comprising the retaining wall blocks. It will be appreciated by those skilled in the art that obvious changes can be made to the embodiments described in the foregoing description without departing from the broad inventive concept thereof. It is understood, therefore, that this disclosure is not limited to the particular embodiments disclosed, but is intended to cover all obvious modifications thereof which are within the scope and the spirit of the disclosure as defined by the appended claims.

I claim:

1. A retaining wall block having spaced-apart front and rear sections interconnected by two laterally spaced-apart side sections that jointly define a through-cavity that extends through the block from a top face thereof to a bottom face thereof, two or more protuberances that protrude outwardly from the top face of the front section frontwardly of the through-cavity, the protuberances having straight front sides and straight rear sides and being laterally spaced apart from one another with the straight rear sides thereof lying along a straight line, and a groove that extends laterally in the bottom face of the front section frontwardly of the through-cavity, the groove being located and dimensioned relative to the protuberances so that two blocks can be stacked one atop another in staggered relation with one or more protuberances of the lower block engaged with one but not both of a front wall and a rear wall of the groove of the upper block and the upper block set back with respect to the lower block.

2. A retaining wall block according to claim 1; wherein the rear sides of the protuberances are flat and extend essentially perpendicularly to the top face of the front section.

3. A retaining wall block according to claim 1; wherein the front section has a rear corner edge that defines the boundary between the top surface thereof and a rear surface thereof, the straight line being coincident with a major part of the rear corner edge.

4. A retaining wall block according to claim 2; wherein the flat rear side of at least one protuberance is flush with a rear surface portion of the front section that defines, in part, the through-cavity.

5. A retaining wall block according to claim 2; wherein the flat rear sides of two protuberances are flush with a rear surface of the front section that defines, in part, the through-cavity.

6. A retaining wall block according to claim 1; wherein the two or more protuberances comprise only four protuberances that are spaced apart from one another in the lateral direction.

7. A retaining wall block according to claim 6; wherein the four protuberances each have a generally rectangular shape with the longer dimension thereof extending in the lateral direction, the two outer protuberances being tapered in the lateral direction with the outer ends thereof being narrower than the inner ends thereof.

8. A retaining wall block according to claim 1; wherein the two or more protuberances comprise only two protuberances that are spaced apart in the lateral direction.

9. A retaining wall block according to claim 1; wherein the protuberances have front and rear sides that are spaced apart from one another a distance less than the distance between the front and rear walls of the groove.

10. A retaining wall block according to claim 1; wherein the two side sections converge toward one another in a direction from the front section to the rear section so that the front, rear and side sections define a trapezoidal shape with the front section longer than the rear section.

11. A retaining wall comprising successive courses of retaining wall blocks stacked one atop another with each succeeding course set back relative to its preceding course and with the blocks of each course being staggered relative to the blocks of adjoining courses, each of the retaining wall blocks being constructed according to claim 1.

12. A retaining wall block having spaced-apart front and rear sections interconnected by two laterally spaced-apart side sections that jointly define a through-cavity that extends in a top-bottom direction through the block from a top face thereof to a bottom face thereof, two or more protuberances that protrude outwardly from the top face of the front section frontwardly of the through-cavity, and a groove that extends laterally in the bottom face of the front section frontwardly of the through-cavity, the groove being located and dimensioned relative to the protuberances so that two blocks can be stacked one atop another in staggered relation with one or more protuberances of the lower block engaged with a wall of the groove of the upper block and the upper block set back with respect to the lower block, and the front section having a textured front surface that terminates at the top and at opposite sides of the front section in curved edges and that terminates at the bottom of the front section in a flat edge, the textured front surface being divided into two panels of different widths by a groove that extends in the top-bottom direction and that has opposed curved edges so that each panel terminates at the top and at opposite sides thereof in curved edges and terminates at the bottom in a flat edge.

13. A retaining wall block according to claim 12; wherein the curved edges all have the same shape.

14. A retaining wall block according to claim 12; wherein the groove in the bottom face of the front section is located and dimensioned relative to the protuberances so that two blocks can be stacked one atop another in staggered relation with one or more protuberances of the lower block engaged with one but not both of a front wall and a rear wall of the groove of the upper block.

15. A retaining wall block according to claim 12; wherein the front section has a protruding portion that protrudes into the through-cavity and that extends in the top-bottom direction at a location directly behind the groove that divides the textured front surface into two panels.

16. A retaining wall block according to claim 12; wherein the two or more protuberances comprise only four protuberances that are laterally spaced apart from one another.

17. A retaining wall block according to claim 12; wherein the two or more protuberances comprise only two protuberances that are laterally spaced apart from one another.

18. A retaining wall block according to claim 12; wherein the two panels each have a rectangular shape, the width of one panel being 1.2 to 3 times greater than the width of the other panel.

19. A retaining wall comprising successive courses of retaining wall blocks stacked one atop another with each succeeding course set back relative to its preceding course and with the blocks of each course being staggered relative to the blocks of adjoining courses, each of the retaining wall blocks being constructed according to claim 12.

20. A retaining wall block having spaced-apart front and rear sections interconnected by two laterally spaced-apart side sections that jointly define a through-cavity that extends in a top-bottom direction through the block from a top face thereof to a bottom face thereof, two or more protuberances that protrude outwardly from the top face of the front section frontwardly of the through-cavity, and a groove that extends laterally in the bottom face of the front section frontwardly of the through-cavity, the groove being located and dimensioned relative to the protuberances so that two blocks can be stacked one atop another in staggered relation with one or more protuberances of the lower block engaged with a wall of the groove of the upper block and the upper block set back with respect to the lower block, the front section having a textured front surface that terminates at the top and at opposite sides of the front section in curved edges, the textured front surface being divided into two panels of different widths by a groove that extends in the top-bottom direction and that has opposed curved edges so that each panel terminates at the top and at opposite sides thereof in curved edges, and the front section having a protruding portion that protrudes into the through-cavity and that extends in the top-bottom direction at a location directly behind the groove that divides the textured front surface into two panels.

21. A retaining wall block according to claim 20, wherein the curved edges all have the same shape.

22. A retaining wall block according to claim 20, wherein the bottom edges of the two panels are flat.

23. A retaining wall block having spaced-apart front and rear sections interconnected by two laterally spaced-apart side sections that jointly define a through-cavity that extends in a top-bottom direction through the block from a top face thereof to a bottom face thereof, two or more protuberances that protrude outwardly from the top face of the front section frontwardly of the through-cavity, and a groove that extends laterally in the bottom face of the front section frontwardly of the through-cavity, the groove being located and dimensioned relative to the protuberances so that two blocks can be stacked one atop another in staggered relation with one or more protuberances of the lower block engaged with a wall of the groove of the upper block and the upper block set back with respect to the lower block, the front section having a textured front surface that terminates at the top and at opposite sides of the front section in curved edges, the textured front surface being divided into two panels of different widths by a groove that extends in the top-bottom direction and that has opposed curved edges so that each panel terminates at the top and at opposite sides thereof in curved edges, and the depth of the groove that divides the textured front surface into two panels being greater at the top of the front section than at the bottom of the front section.

24. A retaining wall block according to claim 23; wherein the curved edges all have the same shape.

25. A retaining wall block according to claim 23; wherein the bottom edges of the two panels are flat.

26. A retaining wall block having spaced-apart front and rear sections interconnected by two laterally spaced-apart sides that jointly define a through-cavity extending in a top-bottom direction through the block from a top face thereof to a bottom face thereof, the front section having a front surface divided into two laterally separated panels by a groove that extends in the top-bottom direction from the top face to the bottom face, the depth of the groove being greater at the top of the front section than at the bottom of the front section.

27. A retaining wall block according to claim 26; wherein each panel has a rectangular shape having top, bottom and two opposite side edges, the top and two opposite side edges being curved and the bottom edge being flat.

28. A retaining wall block according to claim 27; wherein the curved edges all have the same shape.

29. A retaining wall block having spaced-apart front and rear sections interconnected by two laterally spaced-apart side sections that jointly define a through-cavity that extends through the block from a top face thereof to a bottom face thereof, two or more protuberances that protrude outwardly from the top face of the front section frontwardly of the through-cavity, the protuberances having front and rear sides, the rear sides being flat and extending essentially perpendicularly to the top face of the front section, and the flat rear side of at least one protuberance being flush with a rear surface portion of the front section that defines, in part, the through-cavity, and a groove that extends laterally in the bottom face of the front section frontwardly of the through-cavity, the groove being located and dimensioned relative to the protuberances so that two blocks can be stacked one atop another in staggered relation with one or more protuberances of the lower block engaged with one but not both of a front wall and a rear wall of the groove of the upper block and the upper block set back with respect to the lower block.

30. A retaining wall block according to claim 29; wherein the flat rear sides of two protuberances are flush with a rear surface of the front section that defines, in part, the through-cavity.

31. A retaining wall block having spaced-apart front and rear sections interconnected by two laterally spaced-apart side sections that jointly define a through-cavity that extends through the block from a top face thereof to a bottom face thereof, the front section having a rear corner edge that defines the boundary between the top surface thereof and a rear surface thereof, two or more protuberances that protrude outwardly from the top face of the front section frontwardly of the through-cavity, the protuberances having front and rear sides, the rear sides being flat and extending essentially perpendicularly to the top face of the front section, and the protuberances being laterally spaced apart from one another with the flat rear sides thereof lying along a straight line coincident with a major part of the rear corner edge of the front section, and a groove that extends laterally in the bottom face of the front section frontwardly of the through-cavity, the groove being located and dimensioned relative to the protuberances so that two blocks can be stacked one atop another in staggered relation with one or more protuberances of the lower block engaged with one but not both of a front wall and a rear wall of the groove of the upper block and the upper block set back with respect to the lower block.

32. A retaining wall block having spaced-apart front and rear sections interconnected by two laterally spaced-apart side sections that jointly define a through-cavity that extends through the block from a top face thereof to a bottom face thereof, four protuberances that protrude outwardly from the top face of the front section frontwardly of the through-cavity and that are spaced apart from one another in the lateral direction to define two outer and two inner protuberances, the four protuberances each having a generally rectangular shape with the longer dimension thereof extending in the lateral direction, and the two outer protuberances being tapered in the lateral direction with the outer ends thereof being narrower than the inner ends thereof, and a groove that extends laterally in the bottom face of the front section frontwardly of the through-cavity, the groove being located and dimensioned relative to the protuberances so that two blocks can be stacked one atop another in staggered relation with one or more protuberances of the lower block engaged with one but not both of a front wall and a rear wall of the groove of the upper block and the upper block set back with respect to the lower block.

* * * * *